US007518475B2

(12) United States Patent
Mills et al.

(10) Patent No.: US 7,518,475 B2
(45) Date of Patent: Apr. 14, 2009

(54) ELECTRICAL SWITCHING APPARATUS, CIRCUIT INTERRUPTER AND METHOD OF INTERRUPTING OVERCURRENTS OF A POWER CIRCUIT

(75) Inventors: Patrick W. Mills, Bradenton, FL (US); Kevin D. Gonyea, Bradenton, FL (US); Richard G. Benshoff, Sarasota, FL (US); James M. McCormick, Bradenton, FL (US)

(73) Assignee: Eaton Corporation, Cleveland, OH (US)

( * ) Notice: Subject to any disclaimer, the term of this patent is extended or adjusted under 35 U.S.C. 154(b) by 132 days.

(21) Appl. No.: 11/782,142

(22) Filed: Jul. 24, 2007

(65) Prior Publication Data

US 2009/0027146 A1 Jan. 29, 2009

(51) Int. Cl.
*H01H 71/40* (2006.01)

(52) U.S. Cl. ..... 335/6; 335/7; 335/18; 335/21; 335/22; 335/23; 335/35; 335/37; 361/42

(58) Field of Classification Search ..... 335/6, 335/7, 18, 21–23, 35–45; 361/42–50
See application file for complete search history.

(56) References Cited

U.S. PATENT DOCUMENTS

| | | | |
|---|---|---|---|
| 4,208,689 | A | 6/1980 | Dunham et al. |
| 4,631,625 | A | 12/1986 | Alexander et al. |
| 5,224,006 | A | 6/1993 | MacKenzie et al. |
| 5,428,495 | A | 6/1995 | Murphy et al. |
| 5,691,869 | A | 11/1997 | Engel et al. |
| 6,061,217 | A | 5/2000 | Grunert et al. |
| 6,175,780 | B1 | 1/2001 | Engel |
| 6,225,883 | B1 | 5/2001 | Wellner et al. |
| 6,307,453 | B1 | 10/2001 | Wellner et al. |
| 6,356,426 | B1 | 3/2002 | Dougherty |
| 6,522,228 | B2 | 2/2003 | Wellner et al. |
| 6,522,509 | B1 | 2/2003 | Engel et al. |
| 6,542,056 | B2 | 4/2003 | Nerstrom et al. |
| 6,577,138 | B2 | 6/2003 | Zuercher et al. |

(Continued)

OTHER PUBLICATIONS

Navy—AS, "Circuit Breakers, Trip-Free, Aircraft, General Specification For", Military Specification MIL-C-5809G, Nov. 30, 1987, 43 pp.

(Continued)

*Primary Examiner*—Ramon M Barrera
(74) *Attorney, Agent, or Firm*—Eckert Seamans Cherin & Mellott, LLC; Kirk D. Houser, Esquire

(57) ABSTRACT

A circuit interrupter includes a housing, separable contacts, and an operating mechanism including a latch. The operating mechanism opens the contacts responsive to actuation of the latch. A trip mechanism cooperates with the latch to trip open the contacts. The trip mechanism includes a thermal overload mechanism actuating the latch responsive to a thermal fault caused by current flowing through the contacts, a solenoid cooperating with the thermal overload mechanism to actuate the latch responsive to the electromagnetic device being energized, and a processor repetitively determining a value of the current flowing through the contacts, determining if the value exceeds a predetermined value for a number of occurrences, and responsively energizing the solenoid, in order to actuate the latch contemporaneous with actuation of the latch by the thermal overload mechanism, in order to decrease the time to trip open the contacts.

21 Claims, 4 Drawing Sheets

U.S. PATENT DOCUMENTS

| | | | | |
|---|---|---|---|---|
| 6,625,550 | B1 | 9/2003 | Scott et al. | |
| 6,650,515 | B2 | 11/2003 | Schmalz | |
| 6,710,688 | B2 | 3/2004 | Wellner et al. | |
| 6,744,254 | B2 | 6/2004 | Clarey et al. | |
| 6,813,131 | B2 | 11/2004 | Schmalz | |
| 6,864,765 | B2 | 3/2005 | Wellner et al. | |
| 7,038,562 | B1 * | 5/2006 | Meckler et al. | 335/20 |
| 7,170,376 | B2 | 1/2007 | Mills et al. | |
| 2006/0125582 | A1 | 6/2006 | Mills et al. | |
| 2006/0125583 | A1 | 6/2006 | Mills et al. | |
| 2006/0132267 | A1 | 6/2006 | Walz et al. | |
| 2006/0254893 | A1 | 11/2006 | Mills et al. | |

OTHER PUBLICATIONS

International Searching Authority/European Patent Office, International Search Report and Written Opinion, PCT/IB2008/001914, Dec. 4, 2008, 12 pp.

* cited by examiner

ELECTRICAL SWITCHING APPARATUS, CIRCUIT INTERRUPTER AND METHOD OF INTERRUPTING OVERCURRENTS OF A POWER CIRCUIT

BACKGROUND OF THE INVENTION

1. Field of the Invention

This invention relates generally to electrical switching apparatus and, more particularly, to circuit interrupters, such as, for example, aircraft or aerospace circuit breakers. The invention also relates to methods of interrupting overcurrents of a power circuit.

2. Background Information

Circuit breakers are used to protect electrical circuitry from damage due to an overcurrent condition, such as an overload condition or a relatively high level short circuit or fault condition. In small circuit breakers, commonly referred to as miniature circuit breakers, used for residential and light commercial applications, such protection is typically provided by a thermal-magnetic trip device. This trip device includes a bimetal, which heats and bends in response to a persistent overcurrent condition. The bimetal, in turn, unlatches a spring powered operating mechanism, which opens the separable contacts of the circuit breaker to interrupt current flow in the protected power system.

It is known to provide a cantilevered ambient compensation bimetal operatively associated with the bimetal. The bimetal, when heated, moves an insulative shuttle, which pulls on the ambient compensation bimetal that, in turn, is attached to a trip latch member. An increase or decrease in ambient temperature conditions causes the free end of the bimetal and the free end of the ambient compensation bimetal to move in the same direction and, thereby, maintain the appropriate gap between the two bimetal free ends, in order to eliminate the effects of changes in ambient temperature. Under overcurrent conditions, the bimetal and insulative shuttle pull on the ambient bimetal, which moves the trip latch member to trip open the operating mechanism.

Subminiature circuit breakers are used, for example, in aircraft or aerospace electrical systems where they not only provide overcurrent protection but also serve as switches for turning equipment on and off. Such circuit breakers must be small to accommodate the high-density layout of circuit breaker panels, which make circuit breakers for numerous circuits accessible to a user. Aircraft electrical systems, for example, usually consist of hundreds of circuit breakers, each of which is used for a circuit protection function as well as a circuit disconnection function through a push-pull handle.

Typically, subminiature circuit breakers have provided protection against persistent overcurrents implemented by a latch triggered by the bimetal responsive to $I^2R$ heating resulting from the overcurrent. There is a growing interest in providing additional protection, and most importantly arc fault protection.

During sporadic arc fault conditions, the overload capability of the circuit breaker will not function since the root-mean-squared (RMS) value of the fault current is too small to actuate the automatic trip circuit. The addition of electronic arc fault sensing to a circuit breaker can add one of the elements required for sputtering arc fault protection—ideally, the output of an electronic arc fault sensing circuit directly trips and, thus, opens the circuit breaker. See, for example, U.S. Pat. Nos. 6,710,688; 6,542,056; 6,522,509; 6,522,228; 5,691,869; and 5,224,006.

U.S. Pat. Nos. 6,864,765, 6,813,131, 6,710,688, 6,650,515, and 6,542,056 disclose a circuit breaker including three different trip modes, all of which employ a trip latch to actuate an operating mechanism and trip open separable contacts. The three trip modes include: (1) overcurrent conditions (thermal trip) detected by a bimetal, which actuates a trip latch through a shuttle and an ambient compensation bimetal; (2) arc fault (and/or ground fault) conditions detected by electronic circuits, which energize a trip motor to actuate the trip latch; and (3) relatively high current conditions (instantaneous trip) also attract the trip latch.

U.S. Pat. No. 7,170,376 discloses a miniature coil assembly including a coil controlled by an arc fault detection circuit and a plunger. An elongated ambient temperature compensating bimetal is interlocked to an ambient temperature slide, whereby lateral movement of such slide is controlled, in part, by the ambient temperature compensating bimetal. The plunger is coupled to the ambient temperature slide, in order to effect an arc fault trip function therewith.

If a circuit breaker operating mechanism does not open the separable contacts relatively quickly, then the internal components of the circuit breaker may be damaged. For example, it is known that separable contacts can weld closed if an overcurrent or fault condition persists for too long a time. Furthermore, an excessive trip time can produce carbon when the separable contacts break the power circuit. This carbon may cause dielectric breakdown after the fault and allow a current carrying path when the circuit breaker is intended to be open. Also, installed circuit breakers may become corroded, stuck or otherwise damaged. This can cause major changes in the ability of the circuit breaker to protect the corresponding power circuit against thermal overloads.

A known circuit breaker includes a fusible link to prevent the fusing of the separable contacts and, thus, the inability to break the power circuit. The fusible link opens if the separable contacts weld or if a dielectric breakdown occurs.

There is room for improvement in electrical switching apparatus such as circuit interrupters.

There is also room for improvement in methods of interrupting overcurrents of a power circuit.

SUMMARY OF THE INVENTION

These needs and others are met by embodiments of the invention, which employ a thermal overload mechanism to actuate an operating mechanism latch responsive to a thermal fault caused by current flowing through separable contacts. An electromagnetic device cooperates with the thermal overload mechanism to actuate the latch responsive to the electromagnetic device being energized. A processor repetitively determines a value of the current flowing through the separable contacts, determines if the value exceeds a predetermined value for a number of occurrences, and responsively energizes the electromagnetic device. This actuates the latch contemporaneous with actuation of the latch by the thermal overload mechanism, in order to decrease the time to trip open the separable contacts.

In accordance with one aspect of the invention, an electrical switching apparatus comprises: a housing; separable contacts; an operating mechanism comprising a latch, the operating mechanism being structured to open the separable contacts responsive to actuation of the latch; and a trip mechanism cooperating with the latch of the operating mechanism to trip open the separable contacts, the trip mechanism comprising: a thermal overload mechanism structured to actuate the latch responsive to a thermal fault caused by current flowing through the separable contacts, an electromagnetic device cooperating with the thermal overload mechanism to actuate the latch responsive to the electromagnetic device being energized, and a processor structured to repetitively determine a value of the current flowing through the separable contacts, to determine if the value exceeds a predetermined value for a number of occurrences, and to responsively energize the electromagnetic device.

The electrical switching apparatus may have a rated current, and the predetermined value may be about twelve times the rated current.

As another aspect of the invention, a circuit interrupter comprises: a housing; separable contacts; an operating mechanism comprising a latch, the operating mechanism being structured to open the separable contacts responsive to actuation of the latch; and a trip mechanism cooperating with the latch of the operating mechanism to trip open the separable contacts, the trip mechanism comprising: a thermal overload mechanism structured to actuate the latch responsive to a thermal fault caused by current flowing through the separable contacts, an electromagnetic device cooperating with the thermal overload mechanism to actuate the latch responsive to the electromagnetic device being energized, and a processor structured to repetitively determine a value of the current flowing through the separable contacts, to determine if the value exceeds a predetermined value for a number of occurrences, and to responsively energize the electromagnetic device, in order to actuate the latch contemporaneous with actuation of the latch by the thermal overload mechanism, in order to decrease the time to trip open the separable contacts.

The processor may be further structured to periodically measure the voltage and to determine the peak value of the current flowing through the separable contacts.

As another aspect of the invention, a method of interrupting current flowing through a power circuit comprises: sensing the current flowing through the power circuit; repetitively determining a value of the current flowing through the power circuit; determining if the value exceeds a predetermined value for a number of occurrences and responsively energizing an electromagnetic device; actuating a latch responsive to the electromagnetic device being energized; contemporaneously actuating the latch responsive to a thermal fault operatively associated with the current flowing through the power circuit; and opening separable contacts responsive to the latch being actuated.

The method may employ as the predetermined value a first predetermined value; add a second predetermined value to an accumulator responsive to the value exceeding the first predetermined value; and energize the electromagnetic device when the accumulator exceeds a third predetermined value.

The method may periodically subtract a fourth predetermined value from the accumulator.

The method may, after a first predetermined time, add the second predetermined value to the accumulator when the value exceeds the first predetermined value; and after a second predetermined time, subtract the fourth predetermined value from the accumulator.

The method may subtract the fourth predetermined value from the accumulator regardless whether the value exceeds the first predetermined value.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

As employed herein, the term "thermal fault" shall mean a thermal overload current condition or other overcurrent condition.

The invention is described in association with an aircraft or aerospace arc fault circuit breaker, although the invention is applicable to a wide range of electrical switching apparatus, such as, for example, circuit interrupters adapted to detect a wide range of faults, such as, for example, arc faults and/or ground faults in power circuits.

Figure 1:
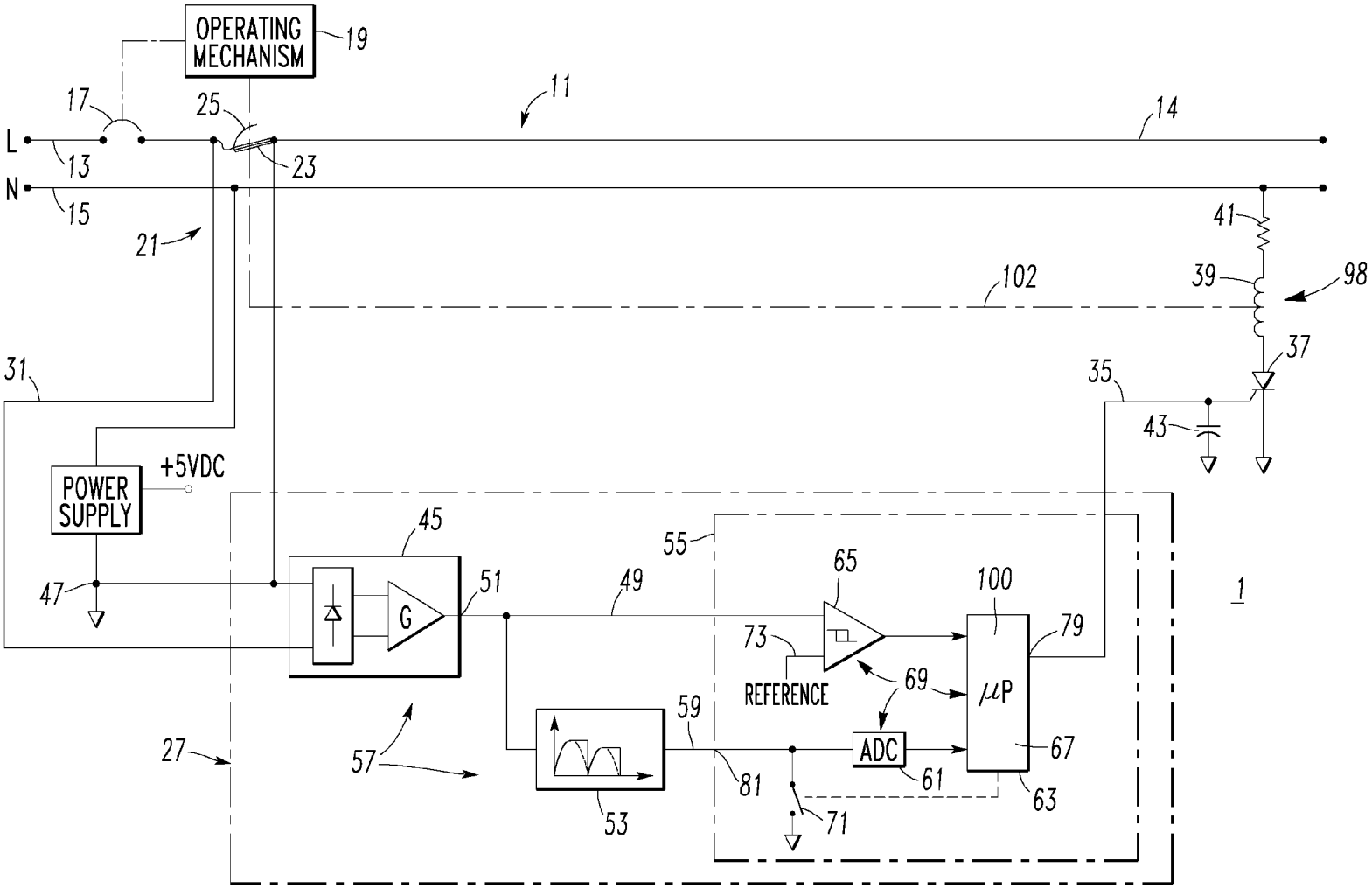
FIG. 1 is a block diagram of a circuit breaker in accordance with embodiments of the invention.

Referring to FIG. 1, an arc fault circuit breaker 1 is connected in an electric power system 11, which has a line conductor (L) 13 and a neutral conductor (N) 15. The circuit breaker 1 includes separable contacts 17, which are electrically connected in the line conductor 13. The separable contacts 17 are opened and closed by an operating mechanism 19. In addition to being operated manually by a handle (not shown), the operating mechanism 19 can also be actuated to open the separable contacts 17 by a trip assembly 21. This trip assembly 21 includes the conventional bimetal 23, which is heated by persistent overcurrents and bends to actuate the operating mechanism 19 to open the separable contacts 17. Although not required, an armature 25 in the trip assembly 21 may be attracted by the large magnetic force generated by very high overcurrents to also actuate the operating mechanism 19 and provide an instantaneous trip function.

The circuit breaker 1 is also provided with an arc fault detector (AFD) 27. The AFD 27 senses the current in the electric power system 11 by monitoring the voltage across the bimetal 23 through the lead 31 with respect to a local ground reference 47. This voltage represents the current flowing through the separable contacts 17. If the AFD 27 detects an arc fault in the electric power system 11, then a trip signal 35 is generated, which turns on a switch such as the silicon controlled rectifier (SCR) 37 to energize a trip coil 39. When energized, the trip coil 39 actuates the operating mechanism 19 to open the separable contacts 17. A resistor 41 in series with the trip coil 39 limits the coil current and a capacitor 43 protects the gate of the SCR 37 from voltage spikes and false tripping due to noise. Alternatively, the resistor 41 need not be employed.

The AFD 27 cooperates with the operating mechanism 19 to trip open the separable contacts 17 in response to an arc fault condition. The AFD 27 includes an active rectifier and gain stage 45, which rectifies and suitably amplifies the voltage across the bimetal 23 through the lead 31 and the local ground reference 47. The active rectifier and gain stage 45 outputs a rectified signal 49 on output 51 representative of the current in the bimetal 23. The rectified signal 49 is input by a peak detector circuit 53 and a microcontroller (μC) 55.

The active rectifier and gain stage 45 and the peak detector circuit 53 form a first circuit 57 adapted to determine a peak amplitude 59 of a rectified alternating current pulse based upon the current flowing in the electric power system 11. The peak amplitude 59 is stored by the peak detector circuit 53.

Figure 4:
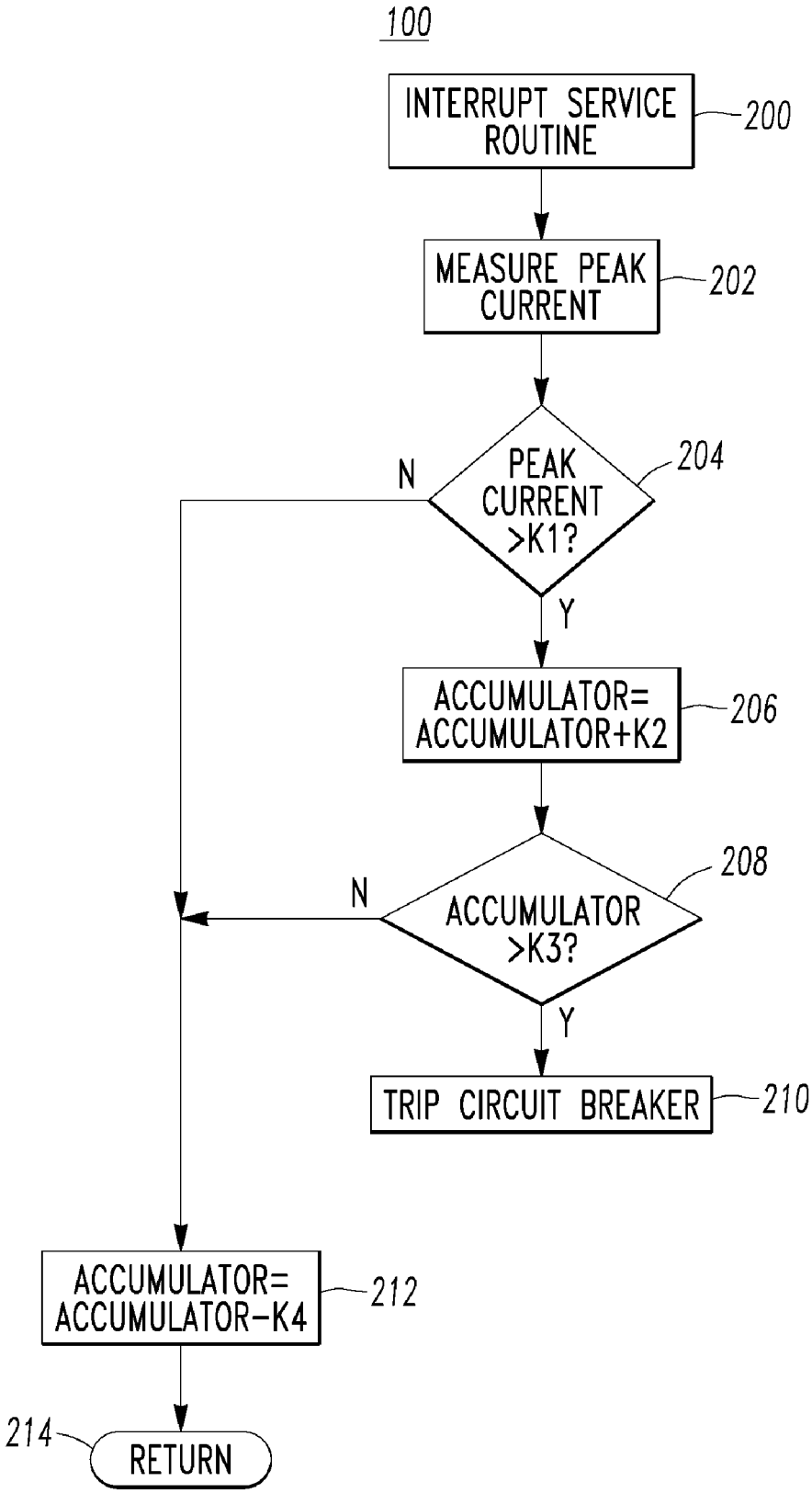
FIG. 4 is a flowchart of firmware executed by the microcontroller of FIG. 1.

The μC 55 includes an analog-to-digital converter (ADC) 61, a microprocessor (μP) 63 and a comparator 65. The μP 63 includes one or more arc fault algorithms 67 and a trip routine 100 (FIG. 4). The ADC 61 converts the analog peak amplitude 59 of the rectified alternating current pulse to a corresponding digital value for input by the μP 63. The μP 63, arc fault algorithm(s) 67 and ADC 61 form a second circuit 69 adapted to determine whether the peak amplitude of the current pulse is greater than a predetermined magnitude. In turn, the algorithm(s) 67 responsively employ the peak amplitude to determine whether an arc fault condition exists in the electric power system 11.

The μP 63 includes an output 71 adapted to reset the peak detector circuit 59. The second circuit 69 also includes the comparator 65 to determine a change of state (or a negative (i.e., negative-going) zero crossing) of the alternating current pulse of the current flowing in the electric power system 11 based upon the rectified signal 49 transitioning from above or below (or from above to below) a suitable reference 73 (e.g., a suitable positive value of slightly greater than zero). Responsive to this negative zero crossing, as determined by the comparator 65, the μP 63 causes the ADC 61 to convert the peak amplitude 59 to a corresponding digital value.

The example arc fault detection method employed by the AFD 27 is "event-driven" in that it is inactive (e.g., dormant) until a current pulse occurs as detected by the comparator 65. When such a current pulse occurs, the algorithm(s) 67 record the peak amplitude 59 of the current pulse as determined by the peak detector circuit 53 and the ADC 61, along with the time since the last current pulse occurred as measured by a timer (not shown) associated with the μP 63. The arc fault detection method then uses the algorithm(s) 67 to process the current amplitude and time information to determine whether a hazardous arc fault condition exists. Although an example AFD method and circuit are shown, the invention is applicable to a wide range of AFD methods and circuits. See, for example, U.S. Pat. Nos. 6,710,688; 6,542,056; 6,522,509; 6,522,228; 5,691,869; and 5,224,006.

A digital output 79 of μP 63 of μC 55 includes the trip signal 35. An analog input 81 of μC 55 receives the peak amplitude 59 for the ADC 61. Hence, the μP 63 measures the voltage of the bimetal 23, determines the value of the current flowing through the separable contacts 17, and generates the trip signal 35.

As will be discussed, below, in connection with FIG. 2, an electromagnetic device, such as a solenoid (e.g., miniature coil assembly 98), includes the trip coil 39 controlled by the μP 63 and a plunger 102. The operating mechanism 19 includes a latch 20 (FIG. 2) and is structured to open the separable contacts 17 responsive to actuation of the latch 20. The μP 63 and miniature coil assembly 98 cooperate with the operating mechanism latch 20 to trip open the separable contacts 17. In particular, the plunger 102, which moves when the trip coil 39 is energized by the μP output 79, is coupled to an ambient temperature compensating bimetal 190 (FIG. 2) and an ambient temperature slide 182 (FIG. 2), in order to effect trip functions therewith. Hence, this trips open the separable contacts 17 (FIG. 1) (170,172 of FIG. 3). The bimetal 23 (FIG. 1) provides a thermal overload mechanism (including bimetal 184 and ambient temperature compensating bimetal 190 of FIG. 2) structured to actuate the latch 20 responsive to a thermal fault caused by current flowing through the separable contacts 17.

As will be discussed, below, in connection with FIGS. 2 and 4, the miniature coil assembly 98 cooperates with the ambient temperature compensating bimetal 190 to actuate the latch 20 responsive to the trip coil 39 being energized by the μP output 79. In particular, the μP routine 100 (FIG. 4) is structured to repetitively determine a value of the current flowing through the separable contacts 17, to determine if the value exceeds a predetermined value for a number of occurrences, and to responsively energize the trip coil 39. This actuates the latch 20 contemporaneous with actuation of such latch by the bimetal 184 (FIG. 2), in order to decrease the time to trip open the separable contacts 17.

Figure 2:
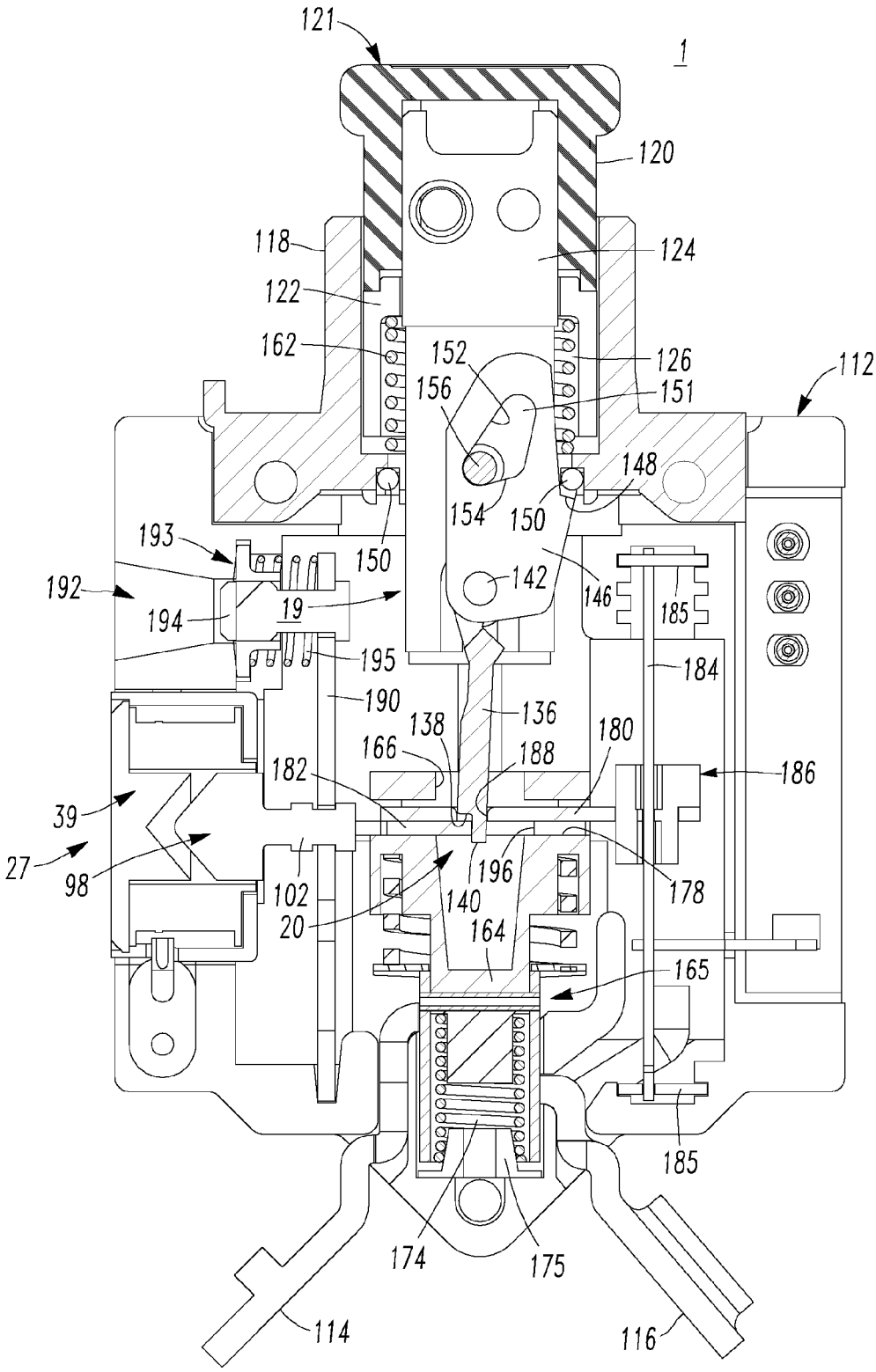
FIG. 2 is a cross-sectional view of the operating mechanism of the circuit breaker of FIG. 1.

Referring to FIG. 2, the circuit breaker 1 comprises an enclosure 112 having a pair of terminals 114 and 116 thereon which extend exteriorly of the enclosure 112 for electrical connection to an electrical source and load, respectively. A threaded, conductive ferrule 118 extends exteriorly of the enclosure 112 for the guidance of a manual operator 120 of a plunger assembly 121. The ferrule 118, in conjunction with a nut (not shown), provides a mounting and electrically conductive connection mechanism for the circuit breaker 1 on a panelboard (not shown).

The manual operator 120 is preferably provided with a trip indicator 122. The manual operator 120 and trip indicator 122 are capable of sliding axial movement with respect to the ferrule 118. The manual operator 120 is provided with a central portion 124 having a central slot 126 extending approximately half the length thereof.

A clevis or thermal latch element 136 is provided with a latch surface 138 and a depending portion 140. The clevis 136 is pivotally supported by a pin 142, which is movable relative to the manual operator 120 in a slot (not shown). The end portions of the pin 142 are retained within grooves (not shown) in the central housing 112, which grooves guide axial movement thereof.

The mechanical latch elements 146 (only one latch element 146 is shown in FIG. 2) are pivotally supported by the pin 142 and are accepted in the slot 126 in the manual operator 120. The latch elements 146 are provided with latching surfaces 148 (only one latching surface 148 is shown in FIG. 2), which are adapted to engage a cooperating latching surface 150 on the ferrule 118. The pivotal latch elements 146 are structured to engage the latching surface 150 until the latch 20 is actuated.

The mechanical latch elements 146 have camming apertures 151 (only one aperture 151 is shown) therein defining camming surfaces 152 (only one camming surface 152 is shown) which are disposed at an acute angle with respect to the axis of reciprocation of the manual operator 120 thereby to effect manual opening of the circuit breaker 1. Two lower camming surfaces 154 (only one camming surface 154 is shown) are disposed at substantially a right angle with respect to the axis of reciprocation of the manual operator 120 to provide positive locking of the circuit breaker 1. The central portion 124 carries a camming pin 156 which extends across the slot 126 therein and through the camming apertures 151 of the mechanical latch elements 146, in order to be in operative engagement therewith.

A spring 162 is provided to resiliently bias the manual operator 120, clevis 136 and latch elements 146 upwardly with respect to the ferrule 118.

Figure 3:
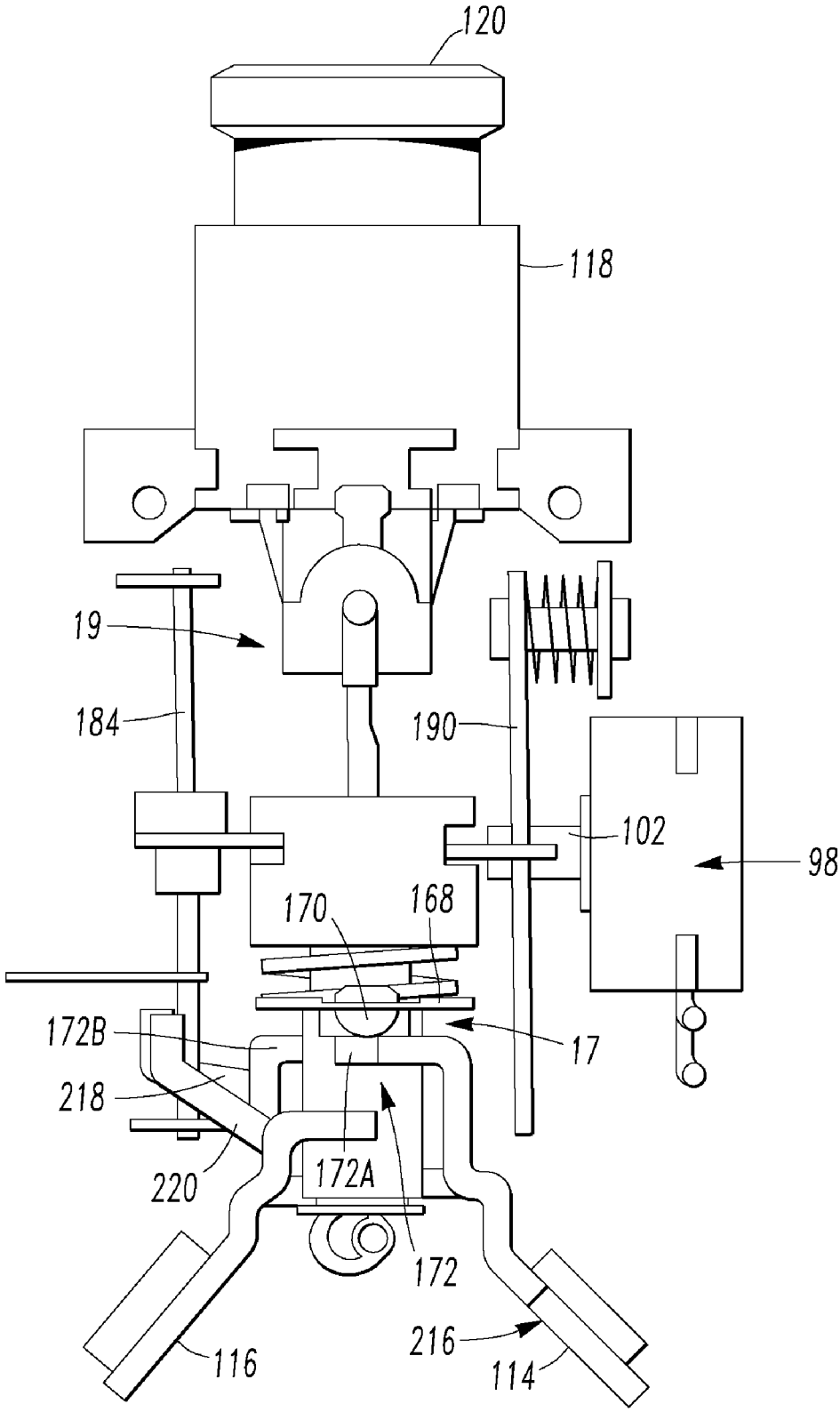
FIG. 3 is a vertical elevation view of a portion of the operating mechanism of FIG. 2 including the thermal overload mechanism.

A movable contact carrier or plunger 164 of a contact plunger assembly 165 has a central opening 166 therein for acceptance of the clevis 136. The contact carrier 164 carries a contact bridge 168 (shown in FIG. 3) having a pair of movable contacts 170 (only one contact 170 is shown in FIG. 3) positioned thereon. The movable contacts 170 are engageable with fixed contacts 172 (FIG. 3) to complete a circuit from terminal 114 to terminal 116 through the current responsive bimetal 184 of the circuit breaker 1, as will be described. A helical coil plunger return spring 174 (FIG. 2) abuts against a spring retainer portion 175 of the housing 112 at one end and the movable contact carrier 164 at its other end, in order to normally bias the contact carrier 164 upwardly relative to the housing 112.

The contact carrier 164 has a laterally extending slot 178 therein for the acceptance of a thermal or overload slide 180 and the ambient temperature slide 182. The overload slide 180 is movable internally of the contact carrier 164 under the influence of the elongated current responsive bimetal 184, which is retained within the housing 112 by end supports 185 at each end thereof.

A clevis guide assembly (e.g., made of ceramic) 186 couples the overload slide 180 to and insulates it from the bimetal 184. The overload slide 180 is provided with a slot 188, which accepts and closely cooperates with the clevis 136 to effect actuation of the latch 20 and release of the clevis 136 in response to lateral movement (e.g., right with respect to FIG. 2) of the slide 180. This, in turn, releases the latch elements 146 in order to open the contacts 170,172.

The ambient temperature slide 182 underlies the overload slide 180 and is movable internally of the contact carrier 164 under the influence of the elongated ambient temperature compensating bimetal 190, which is part of an ambient compensator assembly 192 including an adjustable screw guide 193, a calibrate screw 194 and a compensator spring 195.

The ambient temperature compensating bimetal 190 is interlocked to the ambient temperature slide 182, whereby lateral movement of such slide 182 is controlled, in part, by such bimetal 190. The ambient temperature slide 182 is provided with a slot 196, which, when the circuit breaker 1 is in the contacts closed position, as shown, accepts the hooked end depending portion 140 of the clevis 136. In the contacts closed position, the latch surface 138 of the clevis 136 engages the upper surface of the ambient temperature slide 182 adjacent the periphery of the slot 196 with a pressure determined by the upward resilient bias provided by spring 174.

As an important aspect of the invention, the clevis 136 is released responsive to the overload slide 180, and the ambient temperature slide 182 is structured to contemporaneously release the clevis 136 responsive to the plunger 102 when the trip coil 39 is energized by the μP output 79 (FIG. 1), in order to decrease the time to trip open the separable contacts 17 (FIG. 1).

FIG. 3 shows the current path through the circuit breaker 1 of FIG. 2. When the separable contacts 17 (contacts 170, 172) are closed, the current path is established by a contact assembly 216 including the line terminal 114 and a first fixed contact 172A, the first movable contact 170 to the contact bridge 168 to the second movable contact 170 (not shown), the second movable contact 170 to a second fixed contact 172B, the second fixed contact 172B to a first leg (not shown) of the bimetal 184 by a first flexible conductor 218, through the bimetal 184 to a second leg (not shown) thereof to a second flexible conductor 220, and to the load terminal 116.

EXAMPLE 1

FIG. 4 shows the routine 100, which is executed by the μP 63 of FIG. 1. An interrupt service routine begins, at 200, responsive to a periodic timer interrupt of the μC 55. This enables the μP 63 to periodically (e.g., without limitation, about every 1.25 milliseconds) determine the peak value of the current flowing through the separable contacts 17. Next, at 202, the peak current is read from the ADC 61, which converts the peak amplitude 59 of the rectified alternating current pulse that is stored by the peak detector circuit 53. Next, at 204, it is determined if the peak current, as measured at 202, exceeds a predetermined value (K1) (e.g., without limitation, about twelve times the rated current of the circuit breaker 1 (FIG. 1)). If so, then, at 206, a predetermined value (K2) (e.g., without limitation, five) is responsively added to an accumulator. Since the routine 100 runs periodically, this periodically adds the predetermined value (K2) to the accumulator when the peak current exceeds the predetermined value (K1). Next, at 208, it is determined if the accumulator exceeds a predetermined value (K3) (e.g., without limitation, 20). If so, then at 210, the circuit breaker 1 is tripped by outputting the trip signal 35 (FIG. 1) through the μP output 79. This actuates the latch 20 (FIG. 2) responsive to the miniature coil assembly 98 being energized. This latch 20 is also contemporaneously actuated by the bimetal 184 (FIG. 2) responsive to a thermal fault operatively associated with the current flowing through the power circuit 11. In turn, the separable contacts 17 are opened responsive to the latch 20 being actuated.

If the tests fail at either 204 or 208, then a predetermined value (K4) (e.g., without limitation, one) is subtracted from the accumulator. Since the routine 100 runs periodically, this periodically subtracts the predetermined value (K4) from the accumulator. After 212, the interrupt service routine returns, at 214, to a background routine (not shown) of the μP 63. Alternatively, if the test fails at 204, then step 212 may be skipped and the interrupt service routine returns, at 214.

EXAMPLE 2

The circuit breaker 1 senses the load current through the bimetal 23, which is series with the line conductor 13 and, thus, the load conductor 14. When the μP 63 determines that the sensed current exceeds about twelve times (12×) rated current for a suitable number of occurrences, it outputs the trip signal 35 to the trip coil 39, which causes the separable contacts 17 to open. Hence, the routine 100 permits the μP 63 to sense a rapid current spike through the voltage across the bimetal 23 and actuate the trip coil 39 in response thereto.

EXAMPLE 3

For example, the μC 55 (e.g., without limitation, a Peripheral Interrupt Controller (PIC) 16F684 Microcontroller marketed by Microchip Technology Inc. of Chandler, Ariz.) samples the peak current from the bimetal 23 about every 1.25 mS (e.g., without limitation, synchronized with every zero crossing (positive or negative) of the 120 VAC line cycle at 400 Hz). If the sampled peak current is greater than twelve times the circuit breaker rating, then the μP 63 fills an accumulator (bucket). For example, the trip threshold of the accumulator is set to be, for example, greater than 20 units. The μP 63 adds five units for every half-cycle (e.g., every 1.25 mS) that the sampled peak current is greater than twelve times the circuit breaker rating. Also, every cycle (e.g., 2.5 mS), the μP 63 subtracts one unit. Thus, after five example half-cycles (e.g., 6.25 mS), the μP 63 has subtracted two units (since only 2.5 full cycles have elapsed) and has added 25 units (five units per half-cycle times five half-cycles) for a net increase of 23 units (=25 units−2 units), which exceeds the trip threshold.

This is a redundant mechanism to open the separable contacts 17 and typically provides relatively quicker trip times in order to prevent internal component damage. Also, if the separable contacts 17 are bound together or if the operating mechanism 19 is hung up on burrs or foreign debris, then the miniature coil assembly 98 will "hammer" the contacts 17 open with the solenoid force.

EXAMPLE 4

Any number of known or suitable arc fault trip algorithms may be employed by the μP 63 in combination with the example trip routine 100 (FIGS. 1 and 4).

EXAMPLE 5

In the case of overcurrents at the maximum potential short circuit current at rated voltage, the μP 63 rapidly opens the operating mechanism 19 by pulling (e.g., without limitation, left with respect to FIG. 2) the ambient temperature compensating bimetal 190 with the plunger 102 of the miniature coil assembly 98 (e.g., without limitation, trip solenoid) while the bimetal 23 (bimetal 184 of FIG. 2) is deflecting in the opposite direction due to heating. This decreases the trip time due to the combined effects of both movements (e.g., reduced time to disengage the spring loaded latch 20 through an electromechanical assist).

EXAMPLE 6

The disclosed circuit breaker 1 provides a fail-safe and redundant mechanism to initiate a trip and interrupt current flow. If the bimetal 23 (thermal overload mechanism 184, 190) or operating mechanism 19 become damaged and unable (e.g., without limitation, the mechanical trip mechanism may hang up on burrs and/or foreign debris) to thermally trip the operating mechanism 19, then the fail-safe/redundant mechanism reliably initiates the trip. This provides additional safety without the additional cost of a fusible link. This protects the bimetal 23 of the circuit breaker 1 by ensuring a rapid, repeatable trip time. This mitigates damage to the circuit breaker 1, aircraft wiring and surrounding equipment.

EXAMPLE 7

Although separable contacts 17,170,172 are disclosed, suitable solid state separable contacts may be employed. For example, the disclosed circuit breaker 1 includes a suitable circuit interrupter mechanism, such as the separable contacts 17 that are opened and closed by the operating mechanism 19, although the invention is applicable to a wide range of circuit interruption mechanisms (e.g., without limitation, solid state or FET switches; contactor contacts) and/or solid state based control/protection devices (e.g., without limitation, drives; soft-starters).

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An electrical switching apparatus comprising:

a housing;

separable contacts;

an operating mechanism comprising a latch, said operating mechanism being structured to open said separable contacts responsive to actuation of said latch; and a trip mechanism cooperating with the latch of said operating mechanism to trip open said separable contacts, said trip mechanism comprising:

a thermal overload mechanism structured to actuate said latch responsive to a thermal fault caused by current flowing through said separable contacts, an electromagnetic device cooperating with said thermal overload mechanism to actuate said latch responsive to said electromagnetic device being energized, and a processor structured to repetitively determine a value of said current flowing through said separable contacts, to determine if said value exceeds a predetermined value for a number of occurrences, and to responsively energize said electromagnetic device.

2. The electrical switching apparatus of claim 1 wherein said housing comprises a latching surface; and wherein said latch comprises a pivotal latch member structured to engage said latching surface until said latch is actuated, a clevis member pivotally disposed from said pivotal latch member, and a clevis guide mechanism structured to release said clevis member and actuate said latch.

3. The electrical switching apparatus of claim 2 wherein said thermal overload mechanism comprises a bimetal electrically connected in series with said separable contacts; and wherein said clevis guide mechanism comprises an overload slide coupled to said bimetal and movable therewith, said overload slide being structured to release said clevis member.

4. The electrical switching apparatus of claim 3 wherein said thermal overload mechanism further comprises an ambient compensating bimetal, and an ambient temperature slide coupled to and movable with said ambient temperature compensating bimetal, said ambient temperature slide being structured to release said clevis member.

5. The electrical switching apparatus of claim 4 wherein said processor comprises an output; wherein said electromagnetic device comprises a coil structured to be energized by the output of said processor, and a plunger structured to move when said coil is energized; and wherein said plunger is coupled to said ambient temperature slide, in order to trip open said separable contacts when said coil is energized by the output of said processor.

6. The electrical switching apparatus of claim 5 wherein, when said clevis member is released responsive to said overload slide, said ambient temperature slide is structured to contemporaneously release said clevis member responsive to said plunger when said coil is energized by the output of said processor, in order to decrease the time to trip open said separable contacts.

7. The electrical switching apparatus of claim 1 wherein said thermal overload mechanism comprises a bimetal electrically connected in series with said separable contacts; wherein said bimetal includes a voltage thereacross, said voltage being representative of said current flowing through said separable contacts; and wherein said processor comprises an analog to digital converter structured to measure said voltage and to determine the value of said current flowing through said separable contacts.

8. The electrical switching apparatus of claim 1 wherein said electrical switching apparatus has a rated current; and wherein said predetermined value is about twelve times said rated current.

9. The electrical switching apparatus of claim 1 wherein said electromagnetic device is a solenoid.

10. A circuit interrupter comprising:

a housing;

separable contacts;

an operating mechanism comprising a latch, said operating mechanism being structured to open said separable contacts responsive to actuation of said latch; and a trip mechanism cooperating with the latch of said operating mechanism to trip open said separable contacts, said trip mechanism comprising:

a thermal overload mechanism structured to actuate said latch responsive to a thermal fault caused by current flowing through said separable contacts, an electromagnetic device cooperating with said thermal overload mechanism to actuate said latch responsive to said electromagnetic device being energized, and a processor structured to repetitively determine a value of said current flowing through said separable contacts, to determine if said value exceeds a predetermined value for a number of occurrences, and to responsively energize said electromagnetic device, in order to actuate said latch contemporaneous with actuation of said latch by said thermal overload mechanism, in order to decrease the time to trip open said separable contacts.

11. The circuit interrupter of claim 10 wherein said circuit interrupter has a rated current; and wherein said predetermined value is about twelve times said rated current.

12. The circuit interrupter of claim 10 wherein said thermal overload mechanism comprises a bimetal electrically connected in series with said separable contacts, said bimetal including a voltage thereacross, said voltage being representative of said current flowing through said separable contacts; and wherein said processor is further structured to measure said voltage and to determine the value of said current flowing through said separable contacts.

13. The circuit interrupter of claim 12 wherein said processor is further structured to periodically measure said voltage and to determine the peak value of said current flowing through said separable contacts.

14. The circuit interrupter of claim 13 wherein said processor is further structured to periodically determine the peak value of said current flowing through said separable contacts about every 1.25 milliseconds.

15. A method of interrupting current flowing through a power circuit, said method comprising:

sensing said current flowing through said power circuit;

repetitively determining a value of said current flowing through said power circuit;

determining if said value exceeds a predetermined value for a number of occurrences and responsively energizing an electromagnetic device;

actuating a latch responsive to said electromagnetic device being energized;

contemporaneously actuating said latch responsive to a thermal fault operatively associated with said current flowing through said power circuit; and opening separable contacts responsive to said latch being actuated.

16. The method of claim 15 further comprising employing as said predetermined value a first predetermined value;

adding a second predetermined value to an accumulator responsive to said value exceeding said first predetermined value; and energizing said electromagnetic device when said accumulator exceeds a third predetermined value.

17. The method of claim 16 further comprising employing twenty as said third predetermined value.

18. The method of claim 16 further comprising periodically subtracting a fourth predetermined value from said accumulator.

19. The method of claim 18 further comprising employing five as said second predetermined value; and employing one as said fourth predetermined value.

20. The method of claim 18 further comprising after a first predetermined time, adding said second predetermined value to said accumulator when said value exceeds said first predetermined value; and after a second predetermined time, subtracting said fourth predetermined value from said accumulator.

21. The method of claim 20 further comprising subtracting said fourth predetermined value from said accumulator regardless whether said value exceeds said first predetermined value.

* * * * *